US010876048B2

(12) United States Patent
Yates et al.

(10) Patent No.: US 10,876,048 B2
(45) **Date of Patent: *Dec. 29, 2020**

(54) BENEFICIATION OF HYDROCARBONS FROM MINERAL MATRICES

(75) Inventors: James P. Yates, Charleston, IL (US); Charles A. Arnold, Lakewood, CO (US); Christopher A. Arnold, legal representative, Indian Hills, CO (US); William E. Hahn, Aurora, CO (US); Melva Hahn, legal representative, Aurora, CO (US)

(73) Assignee: Micronizing Technologies, LLC, Allen, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/918,177

(22) PCT Filed: Apr. 10, 2006

(86) PCT No.: PCT/US2006/013696

§ 371 (c)(1),
(2), (4) Date: Oct. 9, 2007

(87) PCT Pub. No.: WO2006/110838

PCT Pub. Date: Oct. 19, 2006

(65) Prior Publication Data

US 2009/0120845 A1 May 14, 2009

Related U.S. Application Data

(60) Provisional application No. 60/670,556, filed on Apr. 11, 2005.

(51) Int. Cl.
*C10G 1/00* (2006.01)

(52) U.S. Cl.
CPC ..... *C10G 1/00* (2013.01)

(58) Field of Classification Search
CPC ..... C10G 1/00; C10G 1/008; C10G 15/00; C10G 15/08; C10G 15/10; C10G 15/12; B02C 19/00; B02C 19/18
USPC ..... 208/426; 241/1, 301
See application file for complete search history.

(56) References Cited

U.S. PATENT DOCUMENTS

| | | | | |
|---|---|---|---|---|
| 2,630,306 | A * | 3/1953 | Evans | 208/427 |
| 3,268,432 | A * | 8/1966 | Nance | C10G 15/08 204/156 |
| 3,556,979 | A * | 1/1971 | Needham et al. | C10G 1/02 166/247 |
| 3,617,470 | A * | 11/1971 | Schlinger et al. | 208/408 |
| 3,633,877 | A * | 1/1972 | Bodine | B01F 11/0045 366/113 |
| 3,652,447 | A * | 3/1972 | Yant | C10G 1/02 201/19 |
| 4,054,506 | A * | 10/1977 | Hart et al. | 208/402 |
| 4,176,042 | A * | 11/1979 | Fahlstrom | 208/426 |
| 4,252,189 | A * | 2/1981 | Bodine | B01D 11/0261 166/177.6 |
| 4,255,129 | A * | 3/1981 | Reed et al. | 432/13 |
| 4,323,119 | A * | 4/1982 | Bodine | 166/177.1 |
| 4,891,131 | A * | 1/1990 | Sadeghi | C10G 1/04 208/390 |
| 6,227,473 | B1 * | 5/2001 | Arnold | B02C 13/18 241/1 |
| 2002/0117564 | A1 * | 8/2002 | Hahn et al. | 241/1 |

OTHER PUBLICATIONS

Kerogen. (2010). In Merriam-Webster Online Dictionary. Retrieved Jun. 10, 2010, from http://www.merriam-webster.com/dictionary/kerogen.*

* cited by examiner

*Primary Examiner* — Michelle Stein
(74) *Attorney, Agent, or Firm* — Shannon W. Bates; Harper Bates & Champion LLP

(57) ABSTRACT

Methods for liberating organic carbonaceous products from mineral matrices such as oil shale and the products liberated by the present methods inter alia, the invention in a preferred embodiment subjects oil shale to resonance disintegration including inter alia rapid pressure and directional changes to essentially instantaneously vary forces acting thereon. Oil shale processed by non-impact processing according to the invention liberates kerogen from the mineral matrix to permit subsequent conversion to shale oil or other utilization.

6 Claims, No Drawings

BENEFICIATION OF HYDROCARBONS FROM MINERAL MATRICES

TECHNICAL FIELD

The invention relates generally to methods for beneficiation of desirable organic materials from mineral matrices and the organic materials removed from said matrices, the invention particularly relating to the liberation of kerogen from raw oil shale.

BACKGROUND ART

Known oil shale reserves contain sufficient oil in the form of shale oil to meet domestic energy requirements for generations. An approximately 17,000 square mile deposit in Western Colorado, eastern Utah and southwestern Wyoming is believed to contain more than one trillion barrels of oil, this oil being recoverable only at substantial costs including energy costs necessary for separation of shale oil from mineral matrices within which the oil is included. While substantial research has been directed toward liberation of the oil contained in these oil shale reserves, practical methodology capable of economically tapping the potential in these reserves has yet to be developed. Prior efforts have involved heating of oil shale rock mined from reserves in surface retorts as well as in situ retorting, all such technology having failed to attain commercial viability due in part to the difficulty of separating oil-prone organic material encased in the fine-grained sedimentary rock comprising the mineral portion of oil shale. While petroleum can be pumped from underground deposits in liquid form, oil shale does not contain pumpable liquid hydrocarbons, the hydrocarbon component of oil shale consisting of an organic "solid" generally referred to as kerogen which is encased in a shale matrix. In prior methodology whether in situ or otherwise, the shale matrix must be heated, that is, retorted, in order to produce a form of crude oil known as shale oil. As one example, retorting of oil shale involves heating of raw ore having included kerogen to temperatures of approximately 500 degrees Centigrade to convert the organic portion of the kerogen into gas and condensable oil, a solid mineral residue also being produced which is discarded or used for purposes other than as a source of energy. Since the mineral component of oil shale constitutes major portions thereof and must be heated along with the organic component, tremendous amounts of energy are wasted in heating of the mineral matrix itself since the mineral matrix produces nothing but residue which further presents a disposal problem. In situ processes avoid substantial waste residue creation since such processes typically involve formation of a void space in an in-ground shale reserve by fracture with explosives or by use of hydraulic pressure. Simple removal of that quantity of shale necessary to produce the void space can also be employed. A hot fluid medium can then be injected into the void space in certain methodologies. In other in situ processes, internal combustion is created within void spaces in the shale rock to recover organic material for further processing. Low recovery efficiencies as well as high energy costs plague prior in situ processes. Further, contamination of aquifers is possible with in situ processes. Oil shale formations can also be heated in situ by heating devices placed in an oil shale formation. Surface and underground mining of shale rock, known as ex situ processing, recovers greater quantities of organic material than does in situ methods. In ex situ processes, the shale is mined, crushed in an impact mill and retorted to recover volatile organic materials which are processed further to produce a crude oil which can then be conventionally refined to useable products including gasoline, heating oil and the like. Environmental problems are inherent in ex situ processing since the spent shale resulting from retort of the hydrocarbon from the crushed oil shale rock is a highly alkaline solid having toxic trace elements liberated by exposure to heat, these trace elements including arsenic, copper, cadmium, mercury, molybdenum, lead, selenium, zinc, boron and fluorine inter alia. The spent oil shale rock therefore becomes a source of pollutants in the form of highly mobile ions having environmentally destructive potential additional to the gaseous emissions that unavoidably issue from a retort facility. The environmental downside of prior ex situ oil shale processing only serve to worsen the high energy costs of such processes necessary for heating of the massive amounts of shale rock within which the desired organic material is encased. Prior oil shale processes have not effectively separated the shale rock matrix from the desirable organic material prior to a retorting step. Effective liberation of the organic material primarily in the form of kerogen particles encased in the shale rock in the oil shale ore would allow heating of essentially only the kerogen, that is, the desired organic material, to thereby permit a quantum reduction in the energy required to produce shale oil. The resulting shale oil also would include a reduced heteroatom content and mitigate the negative environmental impact associated with prior handling and disposal of retorted shale wastes. Removal of at least portions of the shale rock from the kerogen would also permit more efficient utilization of the kerogen.

The present invention in the several embodiments thereof intends solution to the problems now plaguing the efforts of the industry to commercialize organic oil-prone compounds obtainable from oil shale reserves. In one embodiment of the invention, methodology is provided for substantially non-impact or low-impact processing of shale rock to substantially liberate kerogen from encasing mineral matrices. The resulting free kerogen whether completely or substantially devoid of adhering or associated mineral particles can then be subjected to heating in a retort to efficiently separate shale oil from the kerogen such that substantial quantities of energy are not wasted in heating of large quantities of rock as is necessary in prior oil shale processes whether in situ or ex situ. Selective retorting of a predominantly organic fraction rather than of bulk oil shale not only results in less energy necessary in the retorting step but also results in a shale oil having a reduced heteroatom content, a consideration important in subsequent refining since these heteroatoms can poison refinery catalysts. Removal of heterotoms from the shale oil also results in favorable environmental effects. Selective retorting of the organic fraction reduces the negative environmental impact associated with handling and disposal of retorted shale rock wastes. The advantage provided by the present methodology occur due to the subjection of oil shale rock containing kerogen to rapid pressure and directional changes in a high velocity gas stream to instantaneously vary forces acting thereon to cleave the shale matrix along natural cleavage planes including cleavage planes between the mineral matrix and kerogen particles, the liberated kerogen then being separated from highly comminuted mineral matrix particles by classification processes to separate particles of varying specific gravities. The resulting kerogen essentially free of the naturally encasing mineral matrix is then retorted efficiently to produce a shale oil suitable for conversion to a form useful for production of energy products such as gasoline, heating oil and the like and for use as raw material as a feedstock in the production of petrochemical-based products including polymers and the like, for direct use as a fuel to generate power such as in a co-generation process, for gasification to produce natural gas or as a feedstock for the production of hydrogen inter alia.

DISCLOSURE OF INVENTION

The disclosures of U.S. Pat. Nos. 6,135,370; 6,227,473; 6,405,948 and 6,726,133 are incorporated hereinto by reference.

The invention herein disclosed encompasses methodology for liberating organic materials primarily in the form of kerogen from an encasing and/or associated mineral matrix as is commonly found in ores typically referred to as oil shales. Oil shale as referred to herein includes inter alia matrices and particularly mineral matrices within which a useful maceral, particularly an organic maceral, is included, encased, contained or associated, and which can include oil shale per se, cannel "coal" or "bog-head coal" and the like. Kerogen as referred to herein includes inter alia bitumens and sub-bituminous organic phases contained, included, encased or associated with such mineral matrices, such organic phases including sporinite and algenite as well as "kerogen" from oil shale rock. The methodology of the invention preferably comprises subjection of kerogen-bearing matrices to alternating increasing and decreasing pressures, which may include shock waves, with abrupt directional changes in a high velocity stream to produce essentially instantaneous changes in forces acting on the matrices, thereby to cleave the material so processed along natural cleavage planes and along physiochemical boundaries between mineral matrices and kerogen phases with a resulting decrease in particle size of both the mineral matrices and kerogen with liberation of kerogen and similar organic material from the mineral matrices. The methods of the invention are practiced within apparatus such as is disclosed in the aforesaid United States patents incorporated hereinto by reference, such processing occurring in a substantially non-impact or low-impact manner with energy efficiencies not possible with processes involving crushing of oil shale ores. In the methods of the invention, the kerogen-bearing mineral matrix is reduced to particles while effectively avoiding mechanical crushing as occurs with use of prior crushing apparatus such as ball mills and the like. Mechanical crushing of a kerogen-bearing mineral matrix such as occurs in oil shale ore smears organic material contained within and otherwise included within the mineral matrix over surfaces of mineral particles resulting from crushing of said matrix. Such crushing prevents separation of the desired organic material from mineral particles except by heating to temperatures capable of volatilizing the organic material, this heating or retorting requiring substantial energy to elevate the temperature of the mineral particles as well as the temperature of the organic materials. The energy required to heat the mineral particles is essentially wasted and also results in highly alkaline spent mineral particles containing toxic trace elements presenting a serious disposal problem.

In preferred embodiments of the invention, oil shale ore is fed into an input of a resonance disintegration mill such as is disclosed in the United States patents incorporated hereinto by reference, the ore becoming immediately entrained in a gaseous flow created by a plurality of rotors moving at speeds on the order of 2500 to 5000 rpm as an exemplary range of rotational speeds. The alternating increasing and decreasing pressures to which the ore is subjected causes the ore to flow in an alternating outward and inward flow around peripheral edges of said rotors and through orifices formed in plates positioned between adjacently located pairs of the plurality of rotors, each orifice plate extending inwardly from internal walls of a housing containing the rotors and orifice plates to a central aperture that provides an orifice about a shaft to which the rotors are mounted for rotation. Pressures acting on the ore alternately increases and decreases as flow passes through each orifice and expands in that space below each orifice plate. Compression and decompression occurs in the flow as vanes on the rotors pass by static structure contained within the housing. The compressions and decompressions may differ in magnitude and duration. The flow of material within the mill is substantially without high angle impacts of the ore on structural portions of the mill.

Rotors employed in a suitable non-impact or low-impact mills can be angularly offset from each other so that the compressions and decompressions are not synchronized. Establishment of a series of compressions and decompressions can occur at different frequencies depending on the number of rotors, the number of apices on the rotors and the number of static interdigitating elements disposed within the housing as well as other structural characteristics of the mill. Pressure change frequencies can be tuned to resonate to characteristics of a particular ore to more effectively process particular ores.

Processing of oil shale ore according to the invention liberates kerogen from mineral matrices within which the kerogen is encased, included or otherwise associated. Kerogen included within, incorporated into or otherwise associated with the mineral matrix of the oil shale ore or the like is thus liberated can be separated from particles of the mineral matrix by classification apparatus and particularly apparatus capable of separating particles based on differences in specific gravity. The kerogen separated from the mineral matrix can be substantially free of adhering and/or free mineral particles or can be associated with reduced amounts including minor amounts of mineral matrix in particulate form, the quantity of mineral matrix partricles being minor relative to the bulk of the mineral matrix originally associated with the kerogen.

Kerogen can then be processed such as by heating in a retort to produce shale oil. The shale oil thus produced has reduced levels of unwanted heteroatoms and toxic trace elements such as mercury, arsenic and the like. The particles of the mineral matrix discarded from the processes of the invention are more environmentally friendly and potentially useable as fill and the like. A resonance disintegration mill used in practice of the invention and as is disclosed in the patent incorporated hereinto by reference exhibits numerous advantages over conventional mechanical grinding or impact pulverization apparatus. The mill referred to herein can be operated at different speeds and within a wide range of different frequencies as will be further described herein.

Accordingly, it is an object of the invention to liberate a desirable organic material such as kerogen from a mineral matrix such as oil shale to produce an oil-bearing organic material capable of further processing to produce an oil useful in the production of hydrocarbons and the like.

It is another object of the invention to reduce pollutants in oil shale refuse by removing the bulk of the mineral matrix of the oil shale ore prior to heating of a separated, substantially organic portion of said ore to produce shale oil.

It is a further object of the invention to produce a useable oil from oil shale and the like at practical costs and with reduced negative environmental consequences.

Further objects and advantages of the invention will become more readily apparent from consideration of the following detailed description of the preferred embodiments thereof.

BEST MODE FOR CARRYING OUT THE INVENTION

The present invention permits pre-retort beneficiation of an organic fraction from a mineral matrix such as oil-bearing kerogen and the like from oil shale, the methods of the invention offering significant cost savings in handling and in kerogen conversion with reduction of environmental consequences associated with retorted shale and the like. According to the invention, kerogen or similar organic material is liberated from an encasing mineral matrix without significant alteration of the chemistry of either the oil-bearing organic material or the mineral matrix. Liberation of the organic material from the shale matrix allows separation of the organic material such as by magnetic or electrostatic processes, float-separation, centrifugal classification or the like prior to a retorting process. In addition to cost savings resulting from the need to heat only the organic material and possibly minor amounts of adhering or associated mineral matrix particles rather than the entirety of the bulk oil shale ore, the invention permits minimization of the environmental consequences of heating large quantities of oil shale ore to temperatures necessary to drive organic volatiles from oil shale ore in a retort as occurs in conventional ex situ oil shale processes. The shale oil produced by retorting of the relatively mineral-free organic kerogen or other organics is also relatively free of undesirable elements including sulfur, nitrogen, iron, arsenic, mercury and the like, thereby improving the refining qualities of the shale oil. Sulfur in shale oil is a refinery catalyst poison and an air pollutant. Nitrogen deactivates and poisons catalysts and at high concentrations produces gum and affects product color and stability. Iron and arsenic plug preheaters and catalyst beds in addition to poisoning catalysts.

Resonance disintegration mills preferably employed according to the present invention to process oil shale ore and the like reduce particle sizes of the ore by application of the physics of destructive resonance, shock waves and vortex-generated shearing forces to selectively differentiate and fragment particles in complex multi-phase materials such as oil shale and the like. Conventional milling methods operate to simply crush and possibly micronize materials such as oil shale, oil sands, and the like with a resultant smearing of oil-bearing organics over surfaces of mineral matrix particles being comminuted by mechanical impacts. Milling according to the invention incrementally increases the magnitude of shock waves generated within a mill and phases forces to enhance process efficiency while minimizing energy transfer to structural portions of the mill. Oil shale ore is fragmented from within according to practice of the present methods rather than being crushed by impacts as in grinding processes. The oil shale thereby cleaves along internal planes in the mineral matrix most susceptible to separation, those most favorable planes in oil shale being the boundaries between the mineral matrix and particles of the more elastic kerogen.

According to preferred methods of practicing the present invention, oil shale ore passed through a conventional vibratory jaw crusher to reduce the size of the ore to approximately three inches or less in length-wise dimension is fed into a resonance disintegration mill such as is disclosed in the United States patents incorporated hereinto to micronize the ore to particle sizes distributed about a mean particle size less than 100 microns. Processing in air, steam or other gas can preferably occur at rotational speeds between 2000 and 5000 rpms. Liberation of kerogen from the host shale matrix occurs as evidenced by examination of the resulting particulate material. Conventional float/sink separation of the processed ore splits the particulates into a light float component comprised substantially of kerogen and a heavy sink component formed primarily of mineral particles. Raw processed samples have a wide range of particle sizes from approximately one micron to approximately 500 microns with a majority of the sample being of particle sizes in a range between 50 and 300 microns, the particles being mainly equidimensional. The kerogen particles containing mineral inclusions are generally in the larger size range, kerogen particles below ten microns being substantially free of mineral inclusions. Raw samples processed at 4500 rpm have a smaller overall particle size, a greater portion of kerogen particles being in the ten-micron or smaller range and a correspondingly greater amount of inclusion-free kerogen than raw samples resulting from processing at 3800 rpm. Intensity and/or duration of processing can be controlled to reduce all kerogen to particle sizes of ten microns or less. At processing speeds exceeding 4500 rpm, kerogen liberated from the shale matrix is essentially free of included mineral matter.

Material balance Fischer Assay analysis of raw oil shale processed within a resonance disintegration mill indicates a yield of shale oil of approximately 32 gallons of oil per ton of processed oil shale, a quantity essentially equal to yields from raw oil shale processed by conventional retorting. The same analysis of oil shale kerogen processed in a resonance disintegration mill and then concentrated by float/sink processes indicates a yield of shale oil of approximately 60 gallons of oil per ton of raw processed shale. The sink fraction recovered in the float/sink process contains an appreciable quantity of organic material as evidenced by an oil yield of approximately 20 gallons per ton of the sink fraction. As noted herein, the sink fraction contains kerogen packets having mineral inclusions, liberation of the mineral inclusions prior to float/sink processing reducing the quantity of organic material in the sink fraction. Kerogen particles liberated in resonance disintegration processing within a size range around and above 50 microns are seen to contain a relatively high percentage of internal mineral inclusions, primarily carbonates and pyrite. Kerogen particles processed by resonance disintegration to a particle size below approximately ten microns in size are seen to be substantially free of included mineral particles.

The kerogen liberated from oil shale ore according to the invention can be hydroretorted by hydropyrolysis, hydrous pyrolysis, that is, retorted in the presence of hydrogen, to provide suitable oil yields, oil yields being the percentage of organic carbon converted to shale oil. As noted herein, kerogen so liberated can be otherwise used for economic benefit. In addition to use in producing a type of crude oil useful in production of fuels and the like, shale oil can be used as a feedstock for the production of petrochemical products such as are used in the production of polymers and the like. Oil shale comminuted according to the invention can particularly be used as an organic raw material in the production of chemical products such as adhesives and resins, cement and building insulation.

Cannel coal, also known as bog-head coal, is a hard, substantially mineralized matrix having a maceral known as algenite with a particle size of approximately 25 microns in a naturally occurring state. Processing according to the invention by resonance disintegration liberates 75% and more of the algenite maceral. Prior utilization of cannel coal involves distillation of the mineral matrix and included algenite, the mineral residue increasing in volume due to heating thereof to result in a substantial disposal problem. Prior processing of cannel coal is also energy inefficient.

The mineral phase of certain formation resulting from processing according to the invention is enriched in sodium and aluminum mineral such as nahcolite and dawsonite inter alia, depending on the nature of the formation. Minerals present in such mineral phases can be utilized.

In preferred embodiments of the invention, mineral matrices such as oil shale ore having organic carbonaceous materials such as kerogen encased, included or associated therewith, are processed by resonance disintegration such as is disclosed in the patents incorporated hereinto by reference. However, resonance processing or resonance disintegration processing according to the invention contemplates subjection of the ore to resonance at a selected frequency or frequencies to cause cleavage along natural cleavage planes and physiochemical boundaries within the ore. Subjection to resonance regardless of the manner by which resonance is generated causes reduction in particle sizes of the mineral matrix and of the carbonaceous material, portions of the particles such as constitute kerogen cleaving at a different rate than occurs with the mineral matrix. Such differential cleavage can occur due to the frequency or frequencies generated. Resonance can be created according to the invention by pulses generated by increasing and decreasing pressure changes acting on the ore. In high velocity streams containing the ore, shearing forces and g-forces act to reduce particle size, all such size reduction mechanisms occurring substantially without impact between the particles and without impact between the particles and surfaces of apparatus employed to generate resonance acting on the particles or to generate other effects on the particles. Inducers, transducers and resonance disintegration mills such as are disclosed in the patents incorporated hereinto by reference induce resonance in the materials to reduce particle sizes without impact affects on the particles. Non-canceling harmonics can be utilized to facilitate resonance processing and speeds within entrained flows can be varied according to the definition of processing according to the invention. Resonance processing in vertically-oriented or horizontally-oriented mills can be effected according to the invention. Standing waves can be generated within such mills to facilitate non-impact reduction of particle sizes.

The composition of matter resulting from non-impact processing of oil shale according to the invention can be used without classification or with only partial removal of particles of the mineral matrix. Reduction of the kerogen to small particle sizes of the size ranges disclosed herein causes the resulting kerogen particles to be more available to reacting chemically due to expanded surface area of said particles. On-site production of a relatively clean kerogen phase allows mixing with locally produced crude oil or slurried for transport to refineries, the cost of constructing and operating a total recovery system at the site of the ore body being thereby obviated.

Removal of kerogen from certain formations such as the well-known Green River formation results in a mineral phase enriched in certain sodium and aluminum minerals such as Nahcolite and Dawsonite that have commercial value. On kerogen removal from oil shales according to the invention followed by classification as aforesaid, the mineral phases enriched in these and other species are saved and utilized.

While the invention has been explicitly disclosed and described herein in relation to particular embodiments, the invention is to be limited only by the scope of the appended claims rather than by the examples and specific embodiments described herein.

The invention claimed is:

1. A method of liberating kerogen from a mineral matrix encasing, including or associated with the kerogen, comprising:

subjecting a shale ore formed of the kerogen and the mineral matrix to resonance disintegration in a high-velocity gas stream at a rotational speed ranging from about 4500 rpm to about 5000 rpm, whereby the mineral matrix and the kerogen are carried along a flow path around a plurality of rotors in an ex situ mill that effects flow of gas, mineral matrix and kerogen in alternating inward and outward directions between an inlet and an outlet, thereby cleaving the ore along one or more natural cleavage planes occurring between the kerogen and the mineral matrix and reducing the ore, including the kerogen and the mineral matrix, into particles, and liberating particles of kerogen from the mineral matrix without additional application of heat.

2. A method for reducing pollutants in shale ore from which substantial quantities of kerogen have been liberated comprising the step of liberating the kerogen from the shale ore according to the method of claim 1 prior to heating of said kerogen to produce shale oil.

3. A method for reducing contaminants in shale oil produced from shale ore comprising the step of liberating kerogen from the shale ore according to the method of claim 1 prior to heating of said kerogen to produce shale oil.

4. The method of claim 1 further comprising the steps of:

separating the liberated kerogen from at least major portions of the mineral matrix; and, processing the liberated kerogen separated from the mineral matrix to produce shale oil.

5. The method of claim 1, further comprising the step of increasing the surface area of discrete particles of the kerogen by reducing particle size.

6. The method of claim 1 wherein the kerogen is processed to produce shale oil external of the mill used to effect the resonance disintegration.

* * * * *